US005751074A

United States Patent [19]

Prior et al.

[11] Patent Number: 5,751,074

[45] Date of Patent: May 12, 1998

[54] NON-METALLIC LIQUID TILT SWITCH AND CIRCUITRY

[75] Inventors: Edward B. Prior, Princeton, Ind.; Anthony J. Caristi, Waldwick; Luis A. Lazo, Passaic, both of N.J.; John E. Prior, Princeton, Ind.

[73] Assignee: Edward B. Prior & Associates, Princeton, Ind.

[21] Appl. No.: 525,958

[22] Filed: Sep. 8, 1995

[51] Int. Cl.[6] ..... H01H 35/02

[52] U.S. Cl. ..... 307/118; 200/61.47; 200/190; 219/250; 307/121

[58] Field of Search ..... 200/61.47, 182–236, 200/190; 340/440–693; 307/112, 125; 219/250

[56] References Cited

U.S. PATENT DOCUMENTS

| | | | |
|---|---|---|---|
| 2,487,433 | 11/1949 | Gardenhour | 200/502 |
| 3,555,219 | 1/1971 | Johnson | 200/61.47 |
| 3,567,881 | 3/1971 | Duimstra et al. . | |
| 3,593,250 | 7/1971 | Norris | 337/114 |
| 3,627,972 | 12/1971 | Chapman | 200/223 |
| 3,673,362 | 6/1972 | Carlson et al. | 200/61.45 |
| 3,683,136 | 8/1972 | Van Den Bosch | 200/61.47 |
| 3,706,867 | 12/1972 | Rand et al. | 200/61.52 |
| 3,715,535 | 2/1973 | Urenda | 200/61.53 |
| 3,786,472 | 1/1974 | Scopacasa | 340/282 |
| 3,876,850 | 4/1975 | Amberny | 200/220 |
| 3,911,666 | 10/1975 | Haber | 58/50 |
| 3,978,301 | 8/1976 | Bitko | 200/220 |
| 3,983,350 | 9/1976 | Camin | 200/61.47 |
| 4,016,752 | 4/1977 | Carey | 73/71 |
| 4,022,998 | 5/1977 | Fohl | 200/61.45 |
| 4,201,900 | 5/1980 | Marchev | 200/220 |
| 4,434,337 | 2/1984 | Becker | 200/220 |
| 4,450,326 | 5/1984 | Ledger | 200/61.45 |
| 4,467,154 | 8/1984 | Hill | 200/61.45 |
| 4,520,257 | 5/1985 | Schwob et al. | 219/250 |
| 4,628,160 | 12/1986 | Canevari | 200/61.45 |
| 4,649,240 | 3/1987 | Davis, Sr. | 200/61.47 |
| 5,039,843 | 8/1991 | Muller | 219/511 |
| 5,143,208 | 9/1992 | Shostek et al. | 200/187 |
| 5,150,104 | 9/1992 | Thomas et al. | 340/686 |
| 5,155,308 | 10/1992 | Blair | 200/61.52 |
| 5,332,876 | 7/1994 | Romano et al. | 200/61.52 |
| 5,365,116 | 11/1994 | Lohss | 307/121 |
| 5,391,846 | 2/1995 | Taylor et al. | 200/233 |

FOREIGN PATENT DOCUMENTS 57-233016 11/1984 Japan .

OTHER PUBLICATIONS

National Semiconductor; Jun. 1992; LM 1830 Fluid Detector.

Motorola Thyristor Device Data 1–2–1; Chapter 2 Theory of Thyristor Operation.

Motorola Thyristor Device Data 2–186; Triacs Silicon Bidirectional Thyristors.

Measurement Systems Application and Design, Ernest O. Doebelin; pp. 592–597.

*Primary Examiner*—J. R. Scott

*Attorney, Agent, or Firm*—Furgang & Milde, LLP

[57] ABSTRACT

An electrical switch sensitive to an externally applied inertial and gravitational force, having an enclosure with a closed space; a conductive fluid filing a first portion of the space and a non-conductive medium filling a second portion of the space, the conductive fluid and the non-conductive medium having differing densities; at least two electrodes in communication with the space; an electrical circuit coupled the contacts and having electrical connections for connection with a power source and a load, having a semiconductor switching device, which is responsive to a current through the contacts, a current through the contacts causing the semiconductor switching device to change in conductivity. An externally applied force, e.g., gravity or inertial force, causes the conductive fluid to move within the enclosure with respect to the contacts, altering a current through the contacts, and thereby changing a conducting state of the semiconductor switching device. The switch resides within a housing, containing both the enclosure and the electrical circuit.

22 Claims, 9 Drawing Sheets

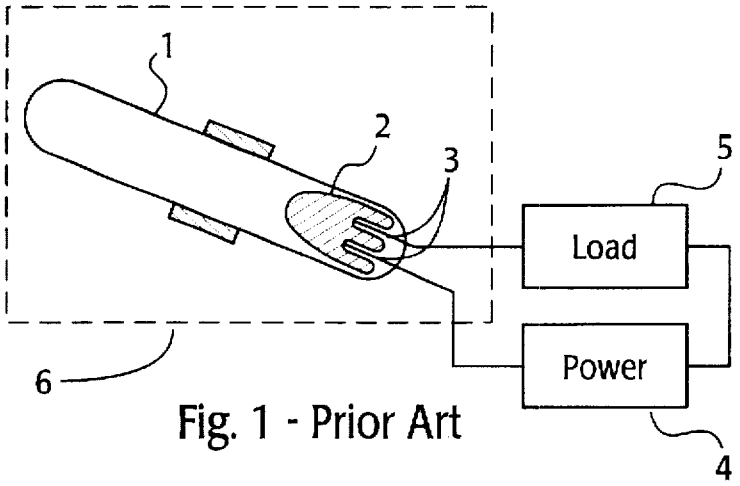
Fig. 1 - Prior Art
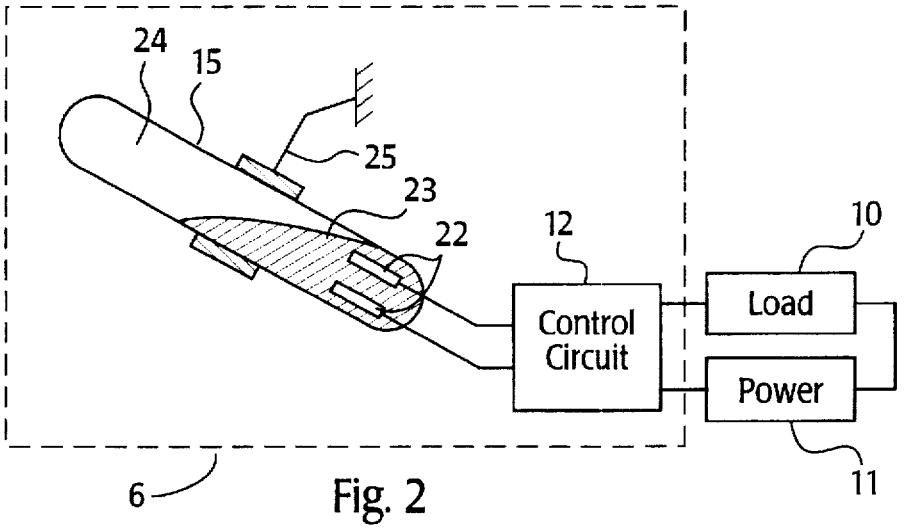
Fig. 2
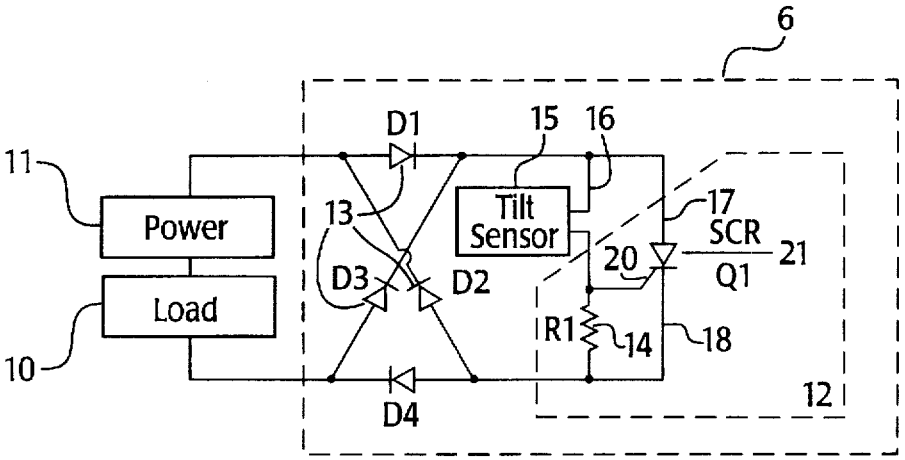
Fig. 3

NON-METALLIC LIQUID TILT SWITCH AND CIRCUITRY

BACKGROUND OF THE INVENTION

1. Field of the Invention

The invention is generally related to electrical switches which employ a dense conducting fluid to selectively provide a conductive bridge between the space separating two electrodes for switching and sensing applications, and more particularly, to non-toxic substitutes for mercury (Hg) which can be used in a switch design having similar performance characteristics in switch applications.

2. Description of the Prior Art

Electrical tilt switches and like devices operate to switch electrical circuits as a function of the angle of inclination of the switch. Such switches normally include a displaceable electrically conductive element that contacts two or more terminals when the conductive element is biased to an operating position by gravity.

Mercury is used extensively in switches and sensors. In a common switch application, liquid mercury is positioned inside a fluid tight housing into which two or more spaced apart electrodes extend, as shown in FIG. 1. Depending on the physical orientation of the housing 1, the liquid mercury 2 can provide a conductive pathway between the electrodes 3 or be positioned such that there is an open circuit between the electrodes 3. An important physical attribute of mercury metal is that it remains fluid throughout a wide temperature range, and can therefore be used in many different environments and in environments with constantly changing parameters. Another significant physical attribute of mercury metal is that it has significant surface tension and does not wet many glass, polymer or metal surfaces. A typical application includes a power supply 4, which powers a load 5 when the circuit through the electrodes 3 and mercury 2 is completed.

Mercury tilt switches are fairly easy to manufacture, however, due to environmental concerns, it is becoming increasingly difficult to manufacture any product that includes mercury. Mercury is a highly toxic substance. As such, there exists a large number of federal, state and local guidelines controlling the use, storage and disposal of mercury.

Mercury metal is sufficiently toxic that human and animal exposure is a significant concern in any application or process in which it is used. Low concentrations can induce psychiatric symptoms in humans. Mercury has also been identified as disrupting the endocrine system in certain wildlife and possibly in humans. Utilization of mercury during manufacturing may present a health hazard to plant personnel, and the disposal of devices that contain mercury switches or the accidental breakage of mercury switches during use may present indirect hazard to people within the immediate vicinity of the switch.

Known mercury switches are shown in U.S. Pat. Nos. 4,201,900, 3,593,250, 5,143,208, 3,911,666, 4,434,337, 3,983,350, 4,694,240, 3,555,219, 3,978,301, 3,876,850, 3,786,472 and 3,627,962. These switches disclose a number of different configurations, useful in inclination, inertial and acceleration sensors.

Japanese Patent Application Sho 57-233016 to Inage et al. discloses a metallic alloy which includes 75% gallium, 19–29% indium, 1–11% tin, and 1–3.5% silver, and discusses its usefulness as a possible substitute for mercury. This alloy has low toxicity, is not very volatile at normal temperatures, has a temperature of congealment below 0 C., and has a resistance of 32 μΩ/cm at 20 C. This patent also identifies Japanese Patent Disclosure Sho 50-101208 as describing a gallium based alloy which includes indium, tin, zinc, silver, and aluminum.

U.S. Pat. No. 5,391,846, Taylor, et al. discloses Gallium-Indium-Tin eutectics for use as a substitute for mercury in switch applications. The eutectics are acid washed to prevent oxidation of the metal components of the eutectic while in the switch housing and the switch housing is filled with an inert gas. In addition, provisions are made to prevent wetting of the switch housing by the eutectic.

Known substitutes suitable for replacement of mercury in switch applications, include a substitute electrically conductive liquid having properties that are similar to mercury, except for toxicity, so that the replacement liquid can be readily implemented into existing manufacturing processes. Table 1 sets forth relevant properties of mercury.

Mercury has a number of characteristics that make it useful in tilt sensors. In fact, toxicity is the major drawback. The advantages include low resistivity, low contact resistance, compatibility with glass and metal envelopes, lack of corrosivity, comparatively low cost, approximately 15 Ampere capacity in common switch configurations, ability to perform in alternating and direct current applications, rapid response time, and a low melting point of −38 C. and a wide temperature of operation.

TABLE 1

| PROPERTIES OF MERCURY METAL | |
|---|---|
| ≈480 dyne/cm surface | tension at 20° C. |
| 13.546 | specific gravity at 20° C. |
| 98 | microohm cm electrical resistivity |
| 0.002 | mmHg vapor pressure at 25.degree. C. |
| −38° C. | melting point |
| 357° C. | boiling point |
| 1.55 cps | viscosity at 20.degree. C. |
| — | acts as a cumulative poison |
| — | air saturated with mercury at 20.degree. C. contains a concentration of mercury that exceeds the toxic limit by more than 100 times |
| — | relatively inexpensive |

Metal wetting of, or reaction with the switch housing is a serious problem for liquid filled switches, because this may reduce a changing in conductance on tilting or erode the components. Mercury has the advantage of a high surface tension and exhibits little wetting of glass or metal housings.

When manufacturing a tilt switch without mercury, a substitute free moving conductive element must be used, and thus a common substitute is a single metal ball, which displays relatively low rolling friction on an inclined surface. Tilt switches utilizing metal balls or movable metal objects which move in an enclosure under an external force, in place of globs of mercury, are exemplified in U.S. Pat. Nos. 5,155,308; 4,628,160; 4,467,154; 4,450,326; 4,022,998; 4,016,752; 3,715,535; 3,706,867; 3,673,362; 3,567,881; and 2,487,433. The use of a metal ball to complete an electric circuit is a simple and inexpensive way to create a tilt switch. However, metal balls do have certain inherent disadvantages. A metal ball contacts a flat surface only along its tangent. Consequently, in many prior art switches that use flat contact points, only a small area of the metal ball is in actual electrically conductive contact within the switch.

U.S. Pat. No. 5,332,876, Romano et al., relates to an electrical tilt switch employing multiple conductive solid spheres. The tilt switch opens or closes an electrical circuit in accordance with the angle of inclination of the switch. A hollow housing having a conductive sphere is provided to move in the housing on inclination, which selectively completes a circuit at one end of the housing on appropriate inclination. A second sphere is also positioned within the housing, sized so that it cannot pass the first sphere, to provide additional force to contact the first sphere with the electrical contacts.

In a typical mercury switch, the mercury glob envelopes an electrical terminal upon contact, resulting in a large surface area through which electricity could be conducted. The comparatively small surface area of a metal ball, through which electricity could be conducted, has made metal ball tilt switches generally less reliable than mercury switches. In general, the current carrying capabilities of non-mercury wetted switches is limited, and arcing or overcurrent conditions may weld the solid to the electrical contact member.

Another disadvantage of conventional metal ball tilt switches is that when a metal ball does contact a terminal, the resulting electrical coupling across the contact area is poor. In a mercury switch, the mercury glob would flow into any pit or void it encountered on a terminal, creating a good electrical coupling. However, with conventional metal ball tilt switches, the metal ball is unable to conduct electricity across any pits or voids that exist on either the surface of the terminal or the metal ball itself. Since electricity passes through the metal ball from the terminal it is contacting, arcing can occur across any void in the contact surface. The arching may cause pitting or corrosion on both the metal ball and the terminal, reducing the conductivity of both surfaces.

Electronic switches are known, including a class called thyristors, including silicon controlled rectifiers ("SCR") and triacs. An SCR is a three terminal device which acts as a unidirectional (DC) switch. When a super-threshold current is supplied to the gate, the device becomes conductive until the voltage across the source and drain returns near zero, resetting the device. SCRs therefore are useful for switching DC loads, where the load is interrupted to reset the device.

On the other hand, a triac is electrically similar to two back-to-back SCRs. The device therefore conducts in both polarities. At each zero crossing, the device is reset, so that the activating gate current must be supplied during each phase. The gate current may be of either polarity to trigger conduction.

A characteristic of both SCRs and triacs is that in useful devices the gate current is small in comparison to the switched current, making these devices amplified-input latching switches. However, for many types of comparable devices, an SCR has a lower gate current and gate voltage than a triac. For example, sensitive gate SCRs include Motorola MCR100, MCR22, C106, MCR70X series, MCR506, MCR72, and MCR310 which have gate current ratings ranging from about 0.075 to 1 mA. Sensitive gate triacs include MAC97A, 2N6071B, MAC228 series, and MAC310 series, which require about 3–5 mA gate current. See, Motorola Thyristor Device Data, 1991, incorporated herein by reference.

Where the current through the switching input is desired to be reduced further, two options are available. First, a thyristor driver circuit may be employed, which conditions the input signal and generates the necessary gate drive conditions for reliable thyristor operation. Such circuits include integrated circuits, Unijunction Transistors (UJTs), Programmable Unijunction Transistors (PUTs), and other discrete devices. Alternatively, high impedance semiconductor devices, including a discrete insulated gate bipolar transistor (IGBT), a metal-oxide-silicon field effect transistor (MOSFET), are known. An optically-isolated triac, e.g., Motorola MOC30XX series, may also be used if the device is supplied with sufficient LED drive current. Of course, other types of electronic amplifiers and switch topologies are known, which are suitable in a variety of applications.

Many different conductive fluids are known. As discussed above, mercury and various eutectics form highly conductive fluids. However, these metals may be toxic, expensive, difficult to work with or otherwise unsuitable for various purposes.

Electrolyte fluids, i.e., fluids with a significant quantity of mobile ionized species are conductive. In general, these solutions may have insufficient conductivity to carry a load or include corrosive ionic species which shorten life under standard conditions.

Aqueous liquid levels may be sensed with electrodes, either by a conduction or by capacitance measurement. See Doebelin, *Measurement Systems Application and Design*, McGraw Hill, 1975, pp. 593–596.

Aqueous fluid level sensors are well known. See, National Semiconductor Corporation Linear Applications Handbook (1986), AN-154, FIG. 11 (LM3909) p. 405; AB-10 (LM1830 fluid level detector integrated circuit), pp. 1079–1080.

SUMMARY AND OBJECTS OF THE INVENTION

It is an object of one embodiment of the present invention to provide an electrically conductive liquid filled inertial or gravitational switch which has performance characteristics similar to mercury switches, but which does not suffer from the toxicity problems inherent in mercury switches.

It is an object of a second embodiment of the present invention to provide a gravitational and/or inertial force sensor having versatile output characteristics, including time delay output, monostable output, debouncing and output hysteresis. This output versatility is obtained by providing an electronic processing circuit which processes a sensor output and drives a switching circuit.

In particular, the present invention provides a switch having an enclosed chamber and an electrode arrangement such that an inclination of the chamber causes an electrically conductive fluid to pool near an electrode in one orientation and allow sufficient conduction to activate an electronic switch, and to pool opposed to the electrode in another orientation to not activate the switch. The electronic circuit is generally activated by conduction between electrodes, but may also be activated by the absence of conduction between electrodes. The conduction may be direct current or alternating current.

The sensor may be configured as a tilt sensor, detecting a change in inclination of the sensor with respect to gravity. The sensor may advantageously also be sensitive to inertial forces, which will also selectively pool the conductive fluid in the enclosure. The fluid may also be sensitive to centrifugal forces in a spinning sensor, or to other forces.

The conductive liquid need not be highly conductive, and low levels of conductivity may be sufficient to reliably trigger the electronic switch. For example, 95% isopropanol/water and denatured alcohol may each be used in a tilt sensor to activate an SCR.

In contrast to a mercury-type tilt switch, which employs an unconditioned output signal, the electronic switch according to the present invention provides an opportunity for signal conditioning which will allow the characteristics of the conductive fluid to be used in a reliable and useful tilt switch. In particular, the low conductivity of the fluid, as compared to mercury or other liquid metallic conductors, is used in a low current circuit to activate an electronic high current switch. The signal conditioning portion of the electronic circuit allows a thin film or small quantity of conductive fluid to bridge the electrodes without undermining the switch function. Optionally, an anti-bounce circuit or time delay circuit may also be included to block input transients or prevent rapid cycling.

The conductive electrodes are preferably formed of nickel, nickel alloy or stainless steel. Other materials, including gold or gold plated metal and platinum surfaces may be employed. Further, graphite or conductive polymers may also be used.

Preferably, a glass envelope is hermetically sealed against an electrode having a suitable composition, such as General Electric number 4 alloy "Dumet", on a portion of the electrode protruding through the envelope. This electrode may be formed as a composite structure having a nickel or nickel plated copper electrode with an unplated copper extension, which is welded to a Dumet portion, which is, in turn, welded to a copper wire for connection to an external circuit.

In order to prevent uncompensated hydrolysis of an electrolyte or pressurization of the sealed enclosure with a potentially explosive mixture, a catalytic recombiner may be provided within the fluid enclosure. For example, the electrode or portion of the tube may be coated with platinum, palladium or another catalytic composition to prevent loss of electrolyte. Further, in order to reduce corrosion and/or plating of the electrodes, an alternating current may be used to sense the impedance of the fluid. A suitable sensing circuit includes the LM1830 Fluid Detector from National Semiconductor. See, Linear Applications Handbook, National Semiconductor Corporation, AB-10, pp. 1079–80, incorporated herein by reference.

Use of a strong catalyst is preferably avoided in proximity to explosive gasses. For example, when used in a flammable liquid tank float sensor, the use of platinum and palladium catalysts may be dangerous. Further, incompatible catalysts are to be avoided where incompatible substances are present in the electrolyte, such as certain polymers.

In general, the electronic circuit will measure a resistance of a conductive fluid, but a circuit may also be used to measure a capacitance of the fluid. In this case, the fluid may be dielectric, or the electrode provided with a dielectric barrier, for measuring a capacitance of an electrolyte, such as sintered tantalum oxide. This capacitance may be measured in a number of known ways. For example, an LM2917 Tachometer integrated circuit from National Semiconductor may be used to measure capacitance changes. See, Linear Applications Handbook, National Semiconductor Corporation, AN-162, pp. 425–441, incorporated herein by reference. A sensor conditioner may also be constructed employing a LM3900 Norton Amplifier, AN-72 or LM339 Comparator, AN-74.

Where the semiconductor switching circuit employs an integrated circuit, supply current may generally be drawn from the switched circuit, which may be a 24V or 120V AC current. Suitable circuits may be formed with a bridge rectifier, Zener diode and filter capacitor for lower voltage, e.g., 24V AC circuits or a single chip step-down power supply such as the Unitrode UCC3889 power supply device for high voltage, e.g., 120V AC circuits. See Unitrode UCC3889 data sheet, incorporated herein by reference. The output of the integrated circuit may be used, or employed to drive a thyristor or other power semiconductor circuit, or to drive the input of an optically isolated triac, e.g., MOC30xx series. Suitable power supply circuits are available from a number of other manufacturers.

Therefore, the present invention provides a hybrid switch structure employing low cost, non-toxic components in an easily manufacturable system. The electronic portion of the device may fully emulate a mercury tilt switch in its characteristics, or provide enhanced characteristics for particular applications.

The electrodes should be placed in the enclosure such that, when the enclosure is inclined so that the electrolyte is away from the electrodes, the surface tension of the electrolyte does not cause substantial drops of electrolyte to bridge the circuit. This may be accomplished by spacing the electrodes far apart or providing a baffle. A small amount of electrolyte wetting the surfaces between the electrodes will not prevent operation of the device, because in general, a minimum current threshold, in excess of the amount passing through the thin film, is required to activate the electronic switch. A low viscosity conductive fluid, such as a volatile alcohol, may be used to reduce surface tension.

In general, a system employing a thyristor semiconductor switch is designed so that the electrodes pass, with an imposed voltage of between about 12 and 120 volts an "on" current of between about 0.2–15 mA, and an "off" current of less than about 30 μA. Of course, the desired "on" and "off" currents are determined based on the characteristics of the thyristor electronic switching device and a suitable margin, and the characteristics of the electrode/conductive fluid system may be selected to achieve a desired system characteristic.

According to other embodiments of the present invention, the electrodes sense a change in capacitance due to pooling of a fluid in the enclosure as a result of various inclination. In this case, the electrical circuit is more complex, but the configuration of the system still includes a liquid filled enclosure with sensing electrodes and a semiconductor circuit for detecting a variation in impedance. Therefore, a portion of dense fluid is provided in an enclosure, with an additional amount of a less dense fluid or gas. As a result of an inertial force or gravity, the dense fluid shifts within the enclosure. Electrodes are provided in the enclosure at a sensing location and are connected to an electrical circuit to distinguish between the electrical properties of the dense fluid as compared to the less dense fluid or gas. The electrodes are connected to an appropriate device which transduce the signal from the electrodes into an output. For example, a thyristor device may be triggered based on the output of the sensor. The transducing electronics and electronic switch are preferably provided in a miniature package, close to the conductive fluid enclosure in a common housing. Further, the entire system preferably acts as a two-terminal device (SPST), the electronic system powered by a small leakage current between the switched leads. The device may also operate as a three terminal (SPDT) switch.

Where necessary, the system may be powered by an external power source, such as a battery or a large value capacitor, e.g., "supercap", or may be powered intrinsically, such as by an intrinsic battery in the tilt sensor. Most systems employing mercury switches allow a small leakage current without adverse consequences. In those cases where such leakage current is impermissible, a separate power supply may be provided for the sensor. Further, the sensor power supply may be isolated from the switched circuit, such as by an optically isolated system, e.g., MOC30XX optically isolated triacs.

The electronic elements are preferably surface mounted components on a fiberglass epoxy circuit board, although other types of circuit mounting, such as TO-92, TO-126, and TO-220 packages are possible. The electronic semiconductor device preferably switches at least 0.8 amp and more preferably 4 amps and preferably has a breakdown voltage of at least 50 V and more preferably 200 V.

The conductive fluid and electrodes are preferably encased in a glass tube which is hermetically sealed. A standard soda-lime glass may be used, so long as it is compatible with the chosen electrolyte. Other types of enclosures may be used, including metal, plastic and ceramic. Of course, where the enclosure is conductive (i.e., metallic), at least one electrode must be insulated from the enclosure to allow operation. The enclosure may be glued, welded, fused, potted, form fitted (e.g., screwed or bayonetted), or force fitted to form a closure.

The present external force sensitive switch may be used in a number of applications, including thermostats, toys, irons, horizontally hinged element light switches, e.g., automotive hood, trunk, glove box, washing-machine door, inertial sensors, such as vehicle deceleration, and other applications, including but not limited to generally those known for mercury switches. Rotational sensors and other types may also be provided. In addition, the present invention provides an opportunity, at low cost and with small increase in complexity, to process the switching signal, such as by introducing a turn-on or turn-off delay, or by requiring a logical relation between two or more sensors, which may be identical or different types. The present device may also find application in fluid level float gages.

The enclosure may be provided with more complex electrode arrangements, such as three or more electrodes to provide a single-pole double throw, staggered or other arrangement. Further, since an electronic circuit processes the electrode currents, the electronic circuit may be provided with a logic circuit or discrimination circuit to allow separate measurements of various electrodes within the enclosure.

According to a first embodiment of the present invention, a full wave rectification circuit is provided between the two terminals of the device. These may be formed with, e.g., 1N4004 diodes. The tilt module is placed in series with a resistor, across the bridge. The junction of the resistor and tilt module is connected to the gate of an SCR, which is also placed across the bridge. When current passes through the tilt module, it causes a voltage drop across the tilt module, injecting a current into the SCR gate, and turning it on. The SCR remains on until the current across the bridge, i.e., the anode and cathode of the SCR, drops to a low level below the holding current. When used in an AC system, the SCR will be turned off every current cycle, so that the time resolution will be approximately the same as twice the AC frequency. The SCR is, for example, a 2N5064 (MCR100-4) or MCR704A1. The electrolyte is preferably a weak electrolyte, such as 95% isopropanol/5% water or denatured alcohol. The liquid wetted portion of the electrodes is preferably formed of nickel alloy, and may be formed as rods or in an increased surface area configuration.

According to a second embodiment, a triac is used to switch the load. In this case, the full wave rectification circuit is unnecessary, simplifying the circuit. A low value resistor may be provided to limit current through the tilt module, which selectively provides a current path to the gate. In this case, the "off" state impedance through the sensor must be carefully controlled to ensure reliable operation. The triac circuit requires a relatively large current, about 3–5 mA, which therefore requires a sensor "on" impedance at 24 V of less than about 4kΩ, or a sensor "on" impedance at 120 V or less than about 25 kΩ.

The resistance of a simple parallel plate probe in an electrolyte is approximately given by the formula:

$$R=1000/c\cdot p\cdot d/A\Omega$$

wherein:

A=area of plates ($cm^2$)

d=separation of plates (cm)

c=concentration (gm mol equivalent/liter)

p=equivalent conductance ($\Omega^{-1}$ $cm^2$ $equiv^{-1}$)

(equivalent is the number of moles of a substance that yields one molar equivalent of positive and negative ions).

Thus, assuming a 1.0 $cm^2$ plate area, a 0.2 cm plate separation, an electrolyte concentration of 0.05M of NaCl (p=1), the resistance of the sensor will be about 4kΩ.

The preferred electrolyte includes a freezing point depressor, e.g., an alcohol or antifreeze composition, such as polyethylene glycol, in order to extend operational temperatures. The conductive ionic species in solution may be sodium chloride, magnesium sulfate, hydrochloric acid, sulfuric acid, or other types of acids, bases or salts. The remaining space in the enclosure is filled with air, inert gas, or an active gas. This space may also be filled with a non-conductive liquid, especially one which is immiscible with the electrolyte, such as an oil or organic liquid. Suspended conductive particles may also be included in the solution, so long as these are well suspended in the solution. The nonconductive medium in the enclosure is immiscible with the conductive liquid, and differs from the conductive liquid in density and has significantly lower conductivity.

Where dissimilar metals are employed as electrodes, an electrochemical potential will develop between the electrodes based on known principles. Therefore, a current output will vary based on the availability of electrolyte on and between the electrodes. While this process will erode the electrodes, a sensor lifetime of 1–10 years may reasonably be obtained. Further, because the sensor is self powering, driving of power semiconductors is facilitated and external circuit power draw is reduced.

It is therefore an object of the present invention to provide an electrical switch sensitive to an externally applied inertial and gravitational force, comprising an enclosure having a space; a conductive fluid filling a first portion of said space and a non-conductive medium filling a second portion of said space, said conductive fluid and said non-conductive medium having differing densities; at least two electrical contacts in communication with said space; an electrical circuit coupled to at least one of said contacts and having electrical connections for connection with a power source and a load, having a semiconductor switching device, said semiconductor switching device being responsive to a current through said at least one contact, a current through said contacts causing said semiconductor switching device to change in conductivity, wherein an externally applied force causes said conductive fluid to move within said enclosure with respect to said at least one contact, altering a current through said contact, thereby changing a conducting state of said semiconductor switching device; and a housing, containing said enclosure and said electrical circuit.

It is a further object of the present invention to provide an electrical switch wherein said conductive fluid comprises water, an aqueous electrolyte solution, a polyethylene glycol aqueous solution, and/or a $C_1$ to $C_7$ straight or branched chain alkane, alkene or aryl alcohol solution, such as methyl alcohol, ethyl alcohol, n-isopropyl alcohol, phenol, toluol. Other conductive fluids include acetic acid solution, ammonia solution, acetone, α-hydroxy acetone, and amino acid solutions. The solution preferably has a freezing point below approximately −10 C., provided intrinsically or with a freezing point depressing agent in an amount sufficient to lower a freezing point of said conductive fluid to below about −10 C.

It is a still further object according to the present invention to provide an electrical switch sensitive to a tilting with respect to gravity and/or an acceleration force. The electrical switch may be used as a tilt sensor, and mounted to a pivoted mounting linked to said enclosed space.

It is another object according to the present invention to provide a thermostat sensor comprising an elongated bimetallic temperature sensitive member linked to said enclosure, varying an orientation of said enclosure with temperature.

It is an object according to the present invention to provide an electrical switch having a semiconductor switch wherein said semiconductor switching device comprises a silicon controlled rectifier, a triac, and/or a MOS device, including an insulated gate bipolar transistor and a MOSFET.

It is another object of the present invention to provide an electrical switch having a sealed enclosure comprising a hollow elongated member, said electrodes being proximate to one end of said member, said conductive fluid filling less than about half of said member. The electrical contacts are preferably formed of a material selected from the group consisting of stainless steel and nickel, and optionally have a surface area greater than that of a cylindrically formed member, i.e., having a conductive surface area greater than about πdh, wherein d is a minimum cross section distance and h is a length of said electrode. The surface area may be increased by macroscopic texturing and by providing a flattened aspect ratio.

According to a still further object of the present invention, the electrical switch includes a semiconducting electrical switch and a timing circuit, the timing circuit controlling a temporal relationship between an externally applied force and an induced change in conductivity.

According to another object of the present invention, an electrical switch sensitive to an externally applied inertial and gravitational force is provided, comprising an enclosure having a space; a dielectric fluid having a first dielectric property filling a first portion of said space and a medium having a dielectric property different from said dielectric fluid filling a second portion of said space, said dielectric fluid and said medium having differing densities; at least two probes in communication with said space; an electrical circuit coupled to at least two of said probes and having an output, said electrical circuit being responsive to a change in capacitance between said probes due to a change in position of said dielectric fluid with respect to said medium.

For a detailed understanding of the present invention, reference should now be made to the accompanying drawings and to the following description thereof.

BRIEF DESCRIPTION OF THE DRAWINGS

The foregoing and other objects, aspects and advantages will be better understood from the following detailed description of a preferred embodiment of the invention with reference to the drawings, in which:

FIG. 1 is a cross section of a prior art mercury switch operated system;

FIG. 2 is a cross section of an electrolyte switch according to the present invention;

FIG. 3 is a schematic drawing of a first embodiment electronic switch circuit according to the present invention;

DETAILED DESCRIPTION OF THE PREFERRED EMBODIMENTS OF THE INVENTION

Figure 4:
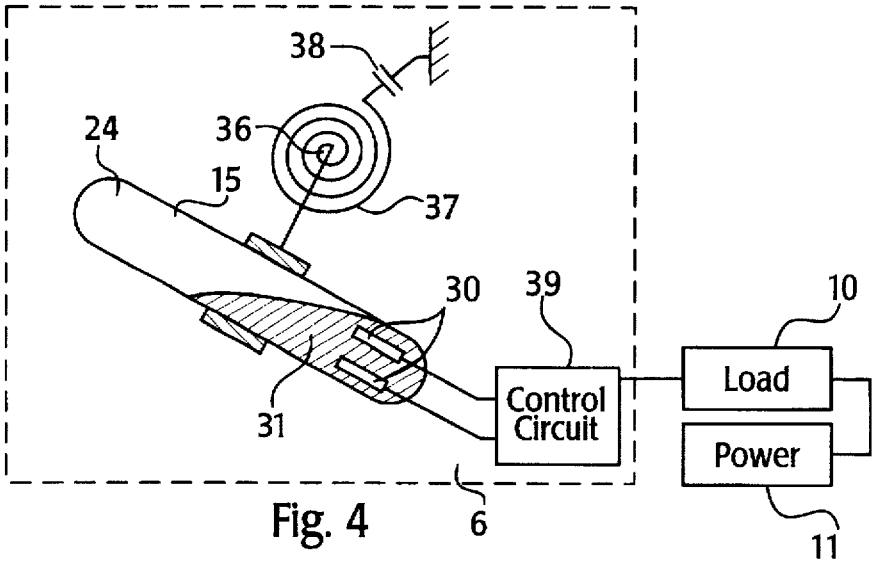
FIG. 4 is a schematic drawing of a second embodiment electronic switch circuit according to the present invention.

The preferred embodiments and the best mode for practicing the present invention will now be described with reference to FIGS. 1–14 of the drawings. Identical elements in the various figures have been assigned the same reference numerals.

EXAMPLE 1

As shown in FIGS. 2 and 3, a two terminal circuit having a 120V AC 100W light bulb as load 10 in series with a 120V AC power source 11 is provided. A control circuit 12, including a full wave rectification circuit is provided between the two terminals, formed with four 1N4004 diodes 13. A 1 kΩ resistor 14 is placed in series with a tilt sensor tube 15, with a lead 16 of the tilt sensor and SCR anode 17 connected to the connected cathodes of the bridge diodes 13, and a lead of the resistor 14 and SCR cathode 18 connected to the connected anodes of the bridge diodes 13. The junction 19 of the tilt sensor tube 15 and resistor 14 are both connected to the gate 20 of the SCR 21, which is a MCR100-4 device (Motorola), the circuitry and tilt sensor reside within housing 6.

The tilt sensor tube 15 is a glass tube approximately 10 mm OD by 40 mm long, 1 mm wall thickness, having two nickel alloy cylindrical rod electrodes 22 each 0.635 mm diameter, approximately 12.5 mm long extending into the tilt sensor tube 15. The electrodes 22 have a gap of approximately 3 mm. About 15% of the tilt sensor tube 15 is filled with conductive fluid 23, the remaining space being air 24. The tilt sensor tube 15 is hermetically sealed.

The conductive fluid 23 is a solution consisting of about 95% isopropanol/5% water. Alternatively, the conductive fluid 23 may contain 100% denatured alcohol or 50% water and 50% automotive antifreeze (Sierra brand).

When current passes through the tilt sensor tube 15 due to conductance between the electrodes 22, it causes a voltage drop across the tilt module, injecting a current into the SCR 21 gate 20, turning it on. The light bulb of the load 10 illuminates. The SCR 21 remains on until the current across the bridge 13, i.e., the anode 17 and cathode 18 of the SCR 21, drops to a low level below the holding current. Because the excitation source is normally AC, the SCR 21 will be turned off every current cycle. The SCR 21 is placed in close proximity to the tilt sensor tube 15. The tilt sensor tube 15 and electronics are mounted on a pivoted member 25. A change of inclination of the member 25 about a threshold inclination is reliably detected.

When water/automotive antifreeze solution is employed, a slight bubbling in the tube is noted. No bubbling was noted with isopropanol or denatured alcohol. The alcohol solutions provide reliable operation and repeatable actuation angle tilt sensors. The water-antifreeze solution is relatively viscous, and was subject to the occasional formation of bridging droplets between the electrodes upon deactivation.

EXAMPLE 2

Figure 5:
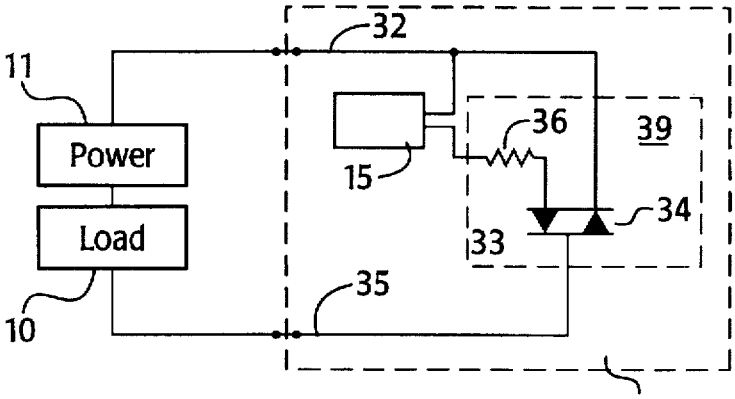
FIG. 5 is a schematic drawing of an electronic control circuit according to FIG. 4.

As shown in FIGS. 4 and 5, a two terminal circuit having a 100Ω relay as a load 10 in series with a 24V AC transformer as power supply 11 is provided. A tilt sensor tube 15, having two flattened stainless steel electrode plates 30, each having between about 1.0 $cm^2$ area, are placed between about 0.25 cm apart. The tilt sensor tube 15 includes an electrolyte solution 31 having about 0.05M sodium chloride. The tilt sensor tube 15 is a 10 mm OD by 40 mm long, 1 mm wall thickness, hermetically sealed glass tube, with the stainless steel electrode plates 30 penetrating through the wall at one end.

The tilt sensor tube 15 is connected between one terminal of the circuit 32 and the gate 33 of a 2N6071B Triac 34. The Triac 34 is placed across the two terminals 32, 35. When current passes through the tilt sensor tube 15, in series with the 100Ω resistor 36, it causes a current to flow through the gate 33 of the Triac 34, turning it on. The Triac 34 remains on until the current across the terminals 32, 35 drops to a level below the holding current. Because the power supply 11 excitation source is AC, the Triac 34 will be turned off every current cycle. The triac 34 is placed in close proximity to the tilt sensor tube 15.

The tilt sensor tube 15 and control circuit 39 electronics are mounted at the center 36 of a coiled bimetallic spring 37, within the housing 6 responsive to a change in temperature. As the temperature changes, the coiled bimetallic spring 37 suffers a differential expansion and contraction, changing the inclination of the tilt sensor tube 15. Therefore, the tilt sensor tube 15 may reliably detect a temperature change. The coiled bimetallic spring 37 is further mounted on a pivotally mounted member 38, so that the trip angle of the tilt sensor tube 15 may be modulated. The tilt sensor tube 15 is therefore useful in a thermostat device.

EXAMPLE 3

Figure 6:
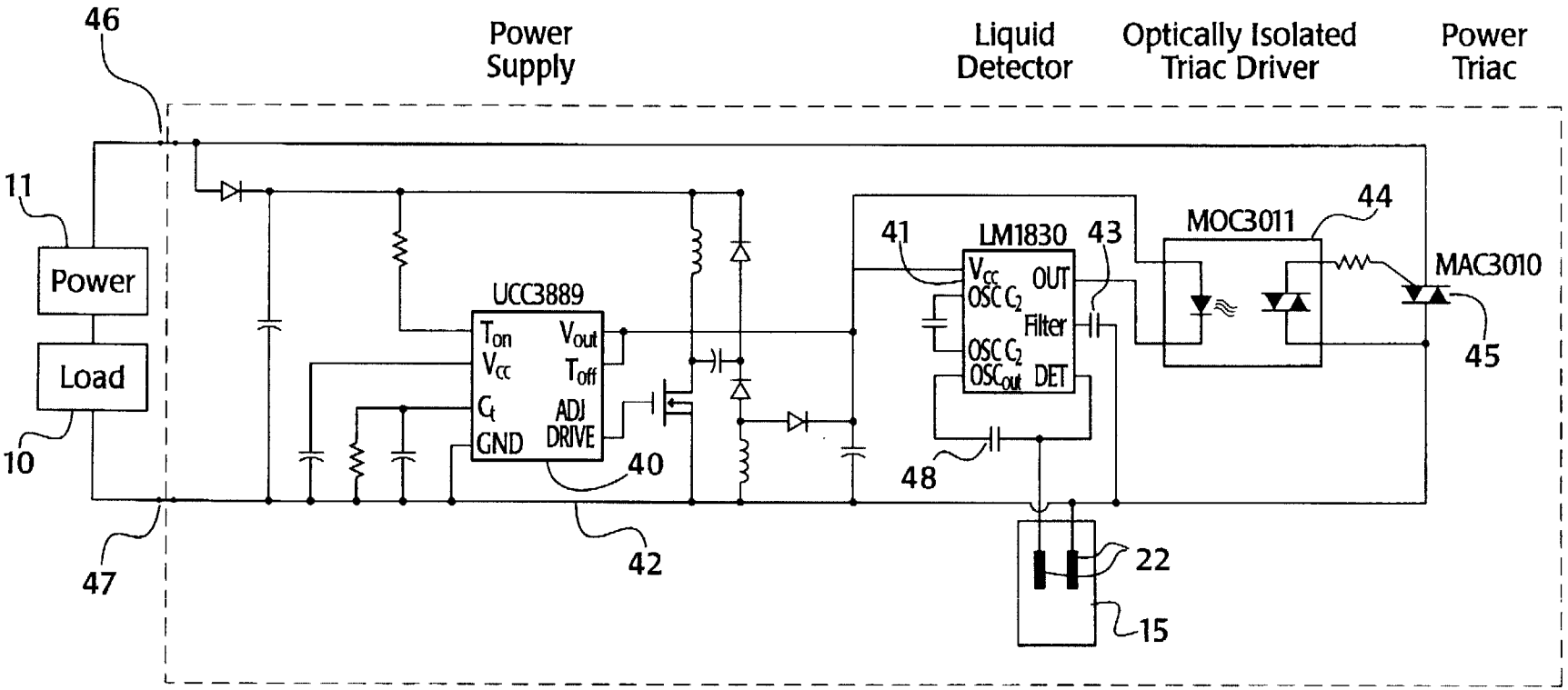
FIG. 6 is a schematic drawing of an electronic control circuit of a third embodiment according to the present invention.

As shown in FIG. 6, a two terminal circuit having a 120V AC 300W inductive load 10 in series with a 120V AC isolation transformer power supply 11 is provided. A Unitrode UCC3889 power supply circuit 40, in conjunction with certain discrete circuitry in a standard configuration (see UCC3889 data sheet), provides a 12V DC output, which, in turn powers an LM1830 fluid detector 41 (see LM1830 data sheet). The leads of the tilt sensor tube 15 are connected to the LMI 830 fluid detector 41 with a capacitively coupled signal and ground 42, respectively. A 100 μF filter capacitor 43 is provided to delay an output and increase immunity to vibration. The output of the LM1830 fluid detector 41 drives the input of an MOC 3011 optically isolated triac driver 44, which in turn drives an MAC 3010-4 triac 45, which allows current to pass through the two terminals 46, 47, powering the load 10.

The tilt sensor tube 15 is a glass tube approximately 10 mm OD by 40 mm long, 1 mm wall thickness, having two nickel alloy cylindrical rod electrodes 22 each 0.635 mm diameter, approximately 12.5 mm long extending into the tilt sensor tube 15. The electrodes 22 have a gap of approximately 3 mm. About 15% of the tilt sensor tube 15 is filled with 95% isopropanol/5% water with 0.001N sodium hydroxide, the remaining space being air. The tilt sensor tube 15 is hermetically sealed.

When current passes through the tilt sensor tube 15 and capacitor 48 from the LM1830 fluid detector 41 oscillator, it triggers the LM1830 fluid detector 41 output, which triggers the MOC optically isolated triac driver 44, which drives a power triac 45. The power triac 45 and MOC optically isolated triac driver 44 remain on until the current across the leads 46, 47 drop to a low level below the holding current. Because the excitation source is normally AC, the triacs will be turned off every current cycle. The electronic circuitry is placed in close proximity to the tilt sensor tube 15. The electronic circuitry and tilt sensor 15 are provided in a housing 6.

EXAMPLE 4

Figure 7:
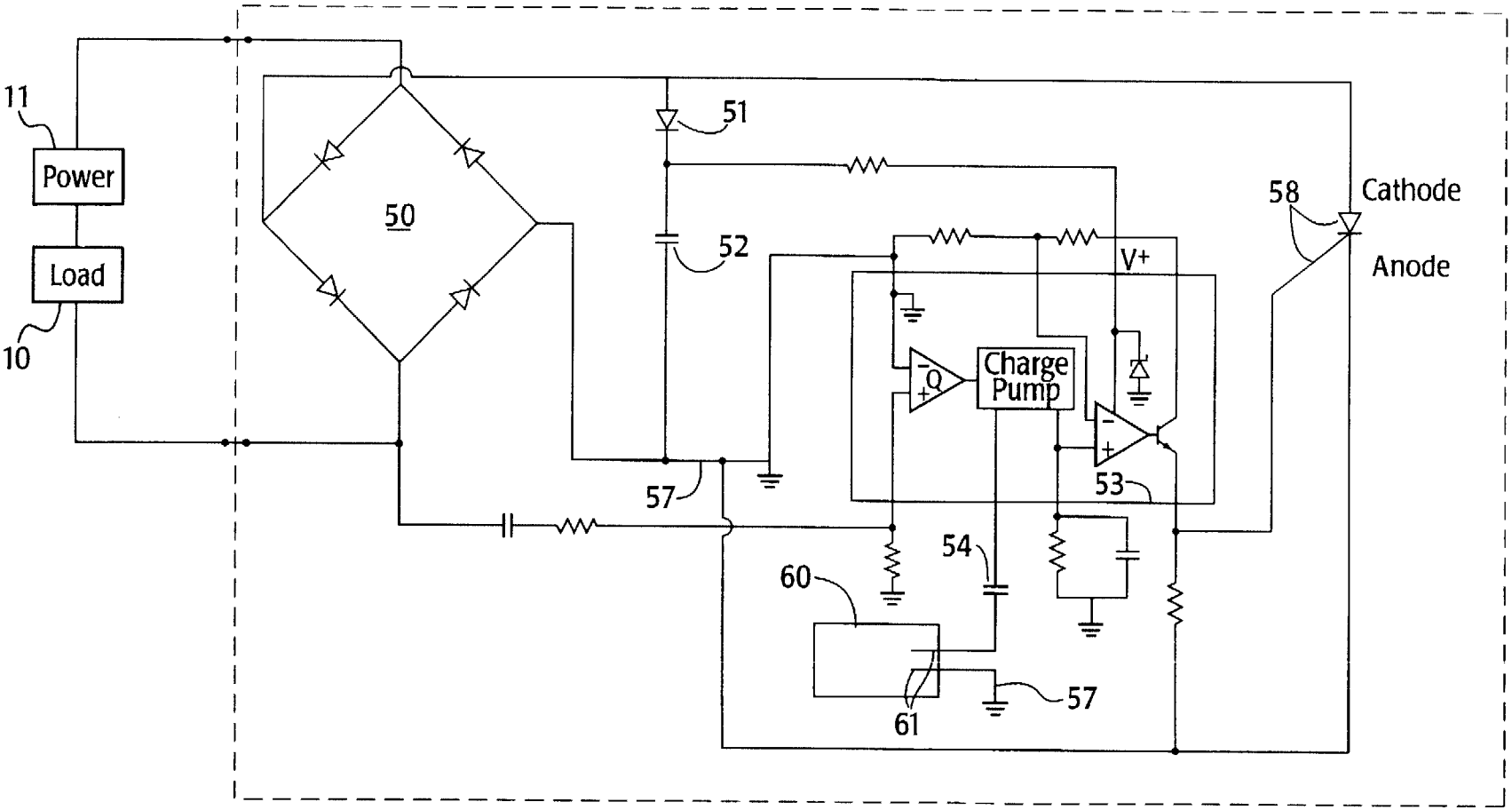
FIG. 7 is a schematic drawing of an electronic control circuit of a fourth embodiment according to the present invention.
Figure 9B:
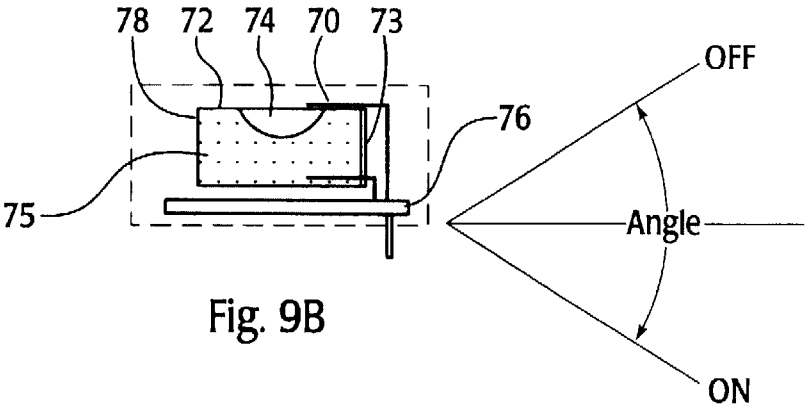
FIGS. 9A, 9B and 9C show a single pole, single throw tilt switch according to the present invention as a sensor tube, sensor tube with electronics, and tilt switch in housing, respectively.
Figure 10A:
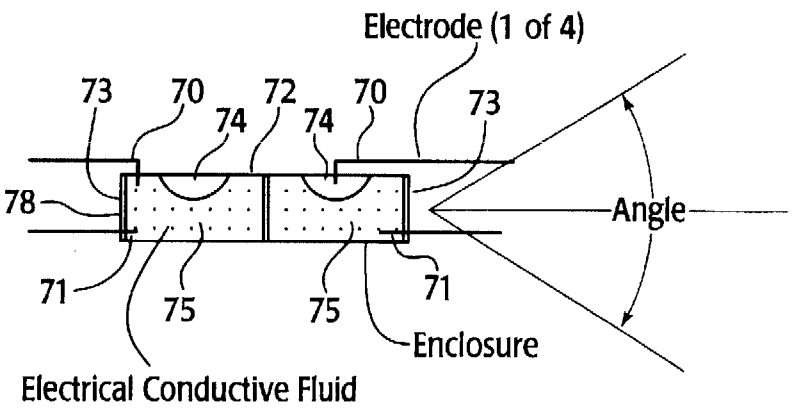
FIGS. 10A, 10B and 10C show a single pole, double throw tilt switch according to the present invention as a sensor tube, sensor tube with electronics, and tilt switch in housing, respectively.
Figure 9A:
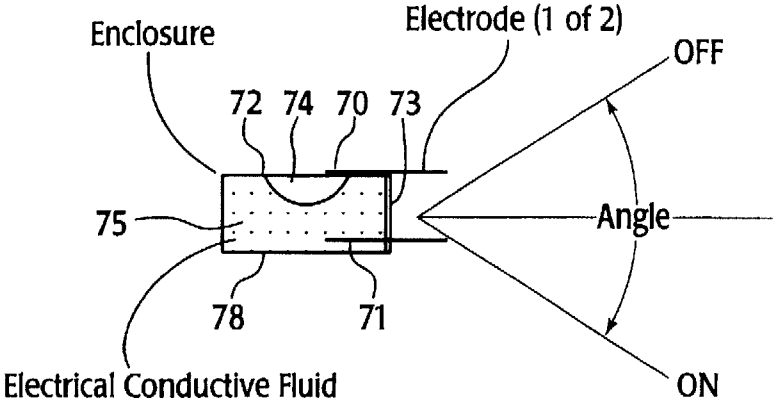
Figure 9C:
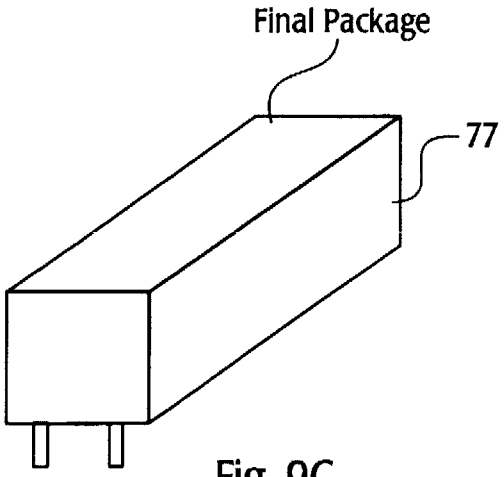
Figure 10C:
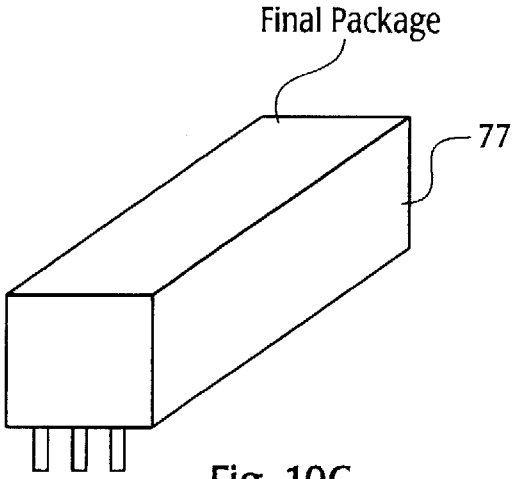
Figure 10B:
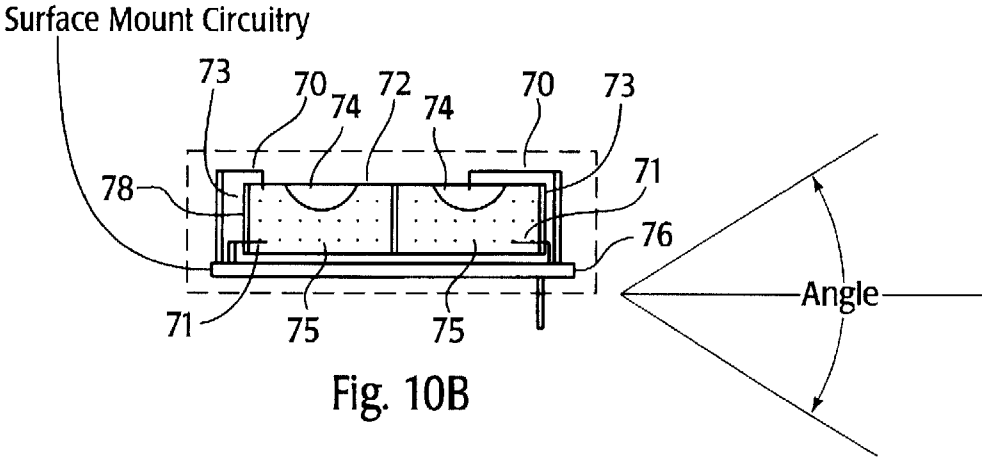

As shown in FIG. 7, a two terminal circuit having a 24V AC transformer power supply 11 in series with a 100Ω relay load 10 is provided. A rectifying bridge 50 is formed by four 1N4004 diodes. A fifth 1N4004 diode 51 in series with a 100 μF capacitor 52 filters the bridge current, powering a LM2917N-8 frequency to voltage converter 53. The capacitance of a liquid-filled tilt sensor tube 15, is measured with the LM917N-8 frequency to voltage converter 53, by connecting one lead 55 of the tilt sensor tube 15, through a 10 μF capacitor 54 and the other lead 56 to ground 57. The output of the LM2917N-8 frequency to voltage converter 53 drives the gate of an MCR100-4 SCR 58, which is placed across the bridge 50. When the capacitance of the tilt sensor tube 60 exceeds a threshold, the output of the LM2917N-8 frequency to voltage converter 53 is activated, causing the SCR 58 to conduct between the anode and cathode, closing the relay. The SCR 58 and LM2917N-8 frequency to voltage converter 53 are placed close to the tilt sensor tube 60.

The tilt sensor tube 60 is a glass tube approximately 10 mm OD by 40 mm long, 1 mm wall thickness, having two stainless steel electrodes 61 each 0.5 mm by 5.0 mm, approximately 12.5 mm long extending into the tilt sensor tube 60. The electrodes 61 have a gap of approximately 3 mm. About 15% of the tube is filled with 95% isopropanol/5% water, the remaining space being air. The tilt sensor tube 61 tube is hermetically sealed. The tilt sensor tube 60 and control circuitry are provided in a housing 6.

EXAMPLE 5

Figure 8:
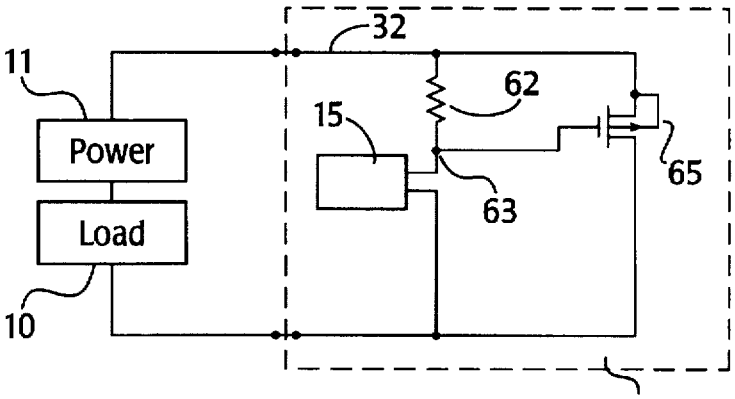
FIG. 8 is a schematic drawing of an electronic control circuit of a fifth embodiment according to the present invention.

As shown in FIG. 8, a two terminal circuit for having a 12 V DC power supply 11 in series with a 50Ω relay load 10 is provided. A tilt sensor tube 15, as described below, is provided in series with a 500 kΩ resistor 62. The junction 63 of the tilt sensor tube 15 and resistor 62 is connected to the gate 64 of an VP0800A p-channel MOSFET 65. When the conductive fluid bridges the electrodes of the tilt sensor tube 15, the gate 64 of the MOSFET 65 is pulled low, inducing current flow and closing the relay of the load 10. The MOSFET 65 and resistor 62 are placed close to the tilt sensor tube 15.

The tilt sensor tube 15 is a glass tube approximately 10 mm OD by 40 mm long, 1 mm wall thickness, having two stainless steel electrodes each 0.635 mm diameter, approximately 12.5 mm long extending into the tube. The electrodes have a gap of approximately 3 mm. About 20% of the tube is filled with 50% water 50% automotive antifreeze, "Sierra" brand, the remainder being air. Both of the electrodes are coated with a thin catalytic platinum film. The tube is hermetically sealed. The tilt sensor tube 15 and control cicuitry, e.g., MOSET 65 and resistor 62, are provided in a housing 6.

EXAMPLE 6

Figure 11C:
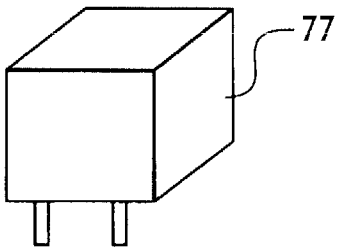
FIGS. 11A, 11B and 11C show a normally closed tilt switch according to the present invention as a sensor tube, sensor tube with electronics, and tilt switch in housing, respectively.
Figure 11B:
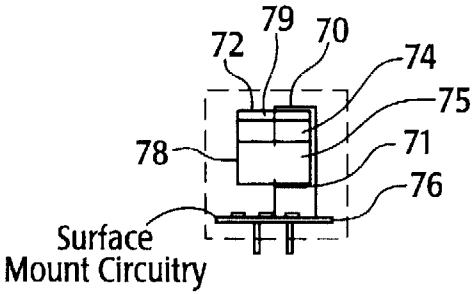
Figure 11A:
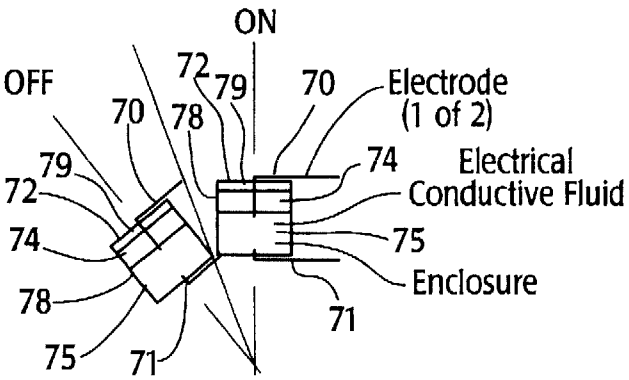
Figure 12A:
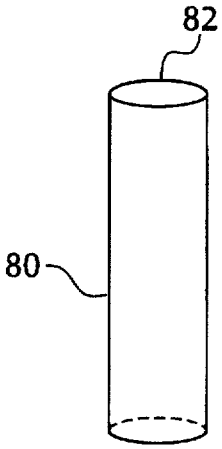
FIGS. 12A–12E show details of the construction of another embodiment of a tilt sensor tube in accordance with the present invention.
Figure 12B:
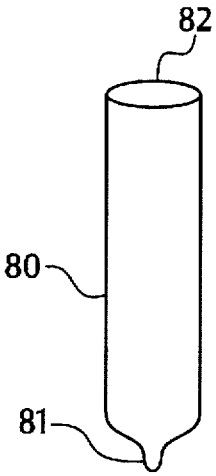
Figure 12C:
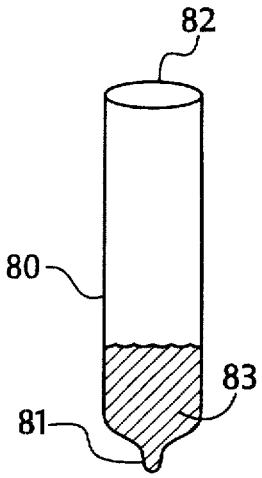
Figure 12D:
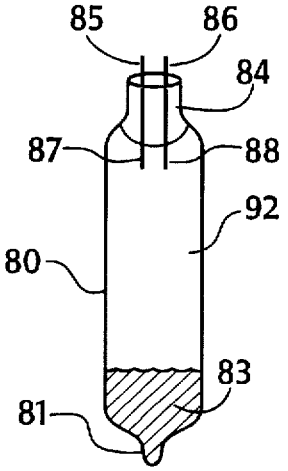
Figure 12E:
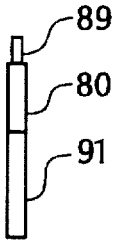

FIGS. 9A, 9B, 9C, 10A, 10B 10C, 11A, 11B and 11C show single pole, single throw, single pole, double throw and normally closed switch arrangements, respectively. A switched electrode 70 is arranged eccentrically in a hermetically sealed tube 72 at an end 73 for single pole switches (FIGS. 9A, 9B, 10A, 10B) or at a central location 79 for normally closed switches (FIG. 11A, 11B). A common electrode 71 is also provided. When an air bubble 74 envelopes the switched electrode 70, the circuit is open and no current flows. When both the switched electrode 70 and common electrode 71 are immersed in conductive fluid 75, the circuit is closed and current flows. A surface mount circuit board 76 including a semiconductor switch is mounted in a common housing 77 with the tilt sensor tube 78.

EXAMPLE 7

FIGS. 12A–12E show an alternate embodiment of a tilt sensor tube in accordance with the present invention. A glass tube 80, approximately 0.730" long×0.175" outer diameter is provided. One end 81 is flamed shut. The tube 80 is filled through its open end 82 approximately one quarter full of a 70% isopropyl alcohol/30% water solution 83 by weight, having 0.005M NaCl.

Two electrodes 85, 86, each formed from a three part structure having a first portion formed of nickel wire 89, approximately 0.010" diameter and 0.025" long, a second portion formed of Dumet number 4 wire 90, approximately 0.020" diameter and 0.075" long, and a third portion formed of copper wire 91 approximately 0.020" diameter and 0.400" long, which is welded together to form a 0.500" long composite structure. The Dumet number 4 wire 90 forms a hermetic seal with glass 82, and other known sealing compositions may also be used.

Both electrodes 85, 86 are then hermetically sealed with heat, in standard manner, to fuse the end 82 of the glass envelope 80 around the Dumet number 4 wire 90 portions of the electrodes 85, 86 and to eliminate the passage to the exterior. The remaining space 92 in the tube 80 may be filled with air, an inert gas such as nitrogen, or allowed to fill with vaporized fluid, i.e., isopropanol/water, due to the heat of the glass tube sealing process. The nickel portion 87, 88 of each electrode 85, 86 protrudes into the interior space of the sealed tube 80, electrically contacting the fluid 83 or gas 92 within the tube 80. The Dumet number 4 wire 90 is preferably coated or covered with glass 84 due to the heat of fusion of the glass.

EXAMPLE 8

Figure 13:
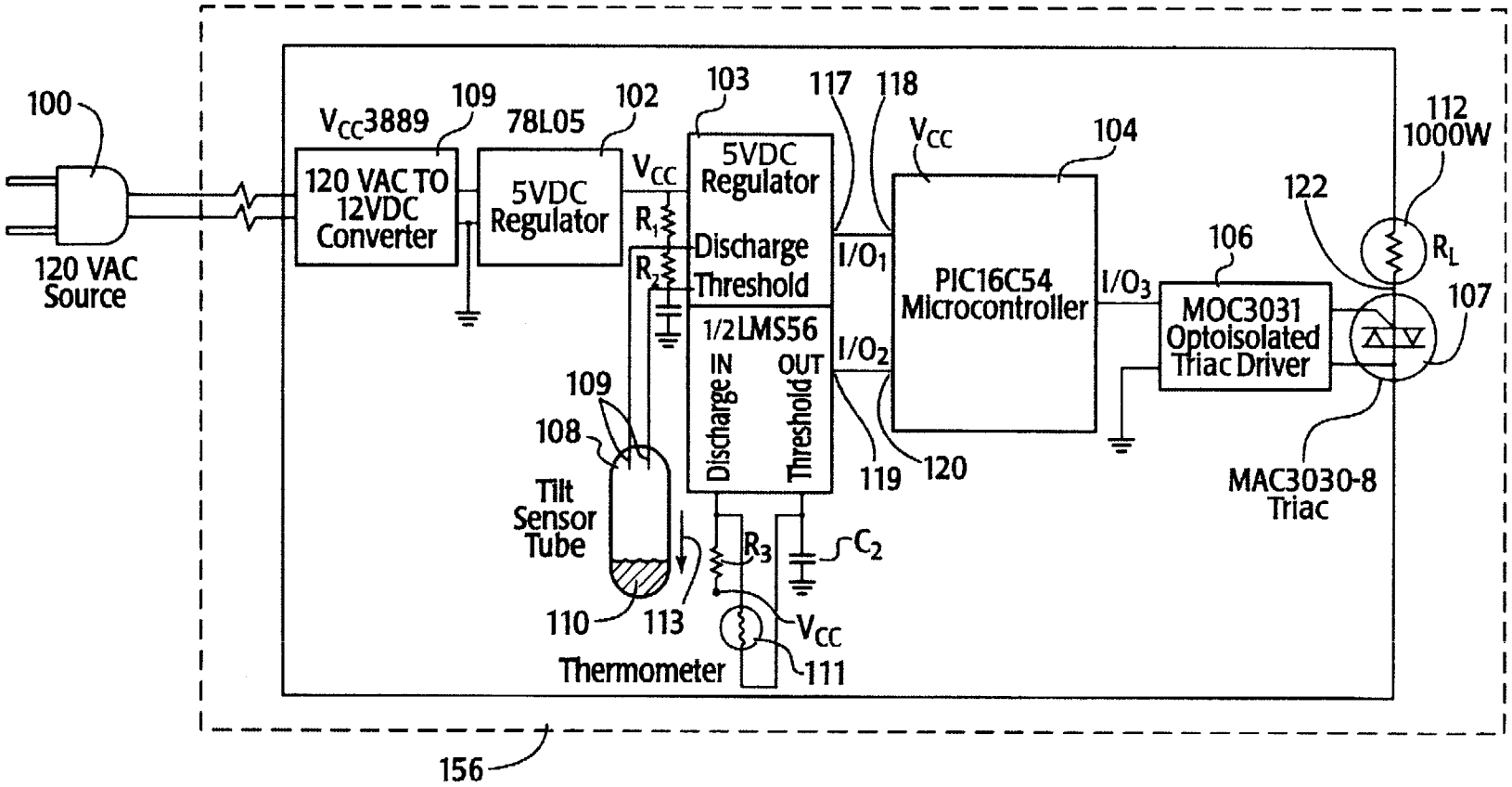
FIG. 13 shows a semischematic diagram of a clothes iron including a tilt sensor according to the present invention.

As shown in FIG. 13, a domestic clothes iron 156 is provided having a 120V AC 1000 W resistive heater 112 powered by 120V AC line current power supply 100. A Unitrode UCC3889 power supply circuit 101, in conjunction with certain discrete circuitry in a standard configuration (see UCC3889 data sheet), provides a 12V DC output, which, in turn is regulated to 5VDC by a 78L05 voltage regulator 102, and powers an LM556 Dual Timer circuit 103, 105 (see LM556 data sheet) and a Microchip PIC 16C54 microcontroller 104. Alternatively, a LM2931 5V regulator or other suitable type may be used. The output of the UCC3889 power supply circuit 101 may also be adjusted to 5VDC. The LM556 dual timer circuit 103, 105 functions to both interface the iron 156 temperature sensor (portion 105 of LM556), a thermistor 111, and the tilt sensor tube 108 (portion 103 of LM556), to the microcontroller 104. A Philips 83C751 or other microcontroller may also be used. The microcontroller 104 controls the temperature of the iron 156, as well as automated shutoff and steam functions, based on time, the status of the tilt sensor tube 108 and the status of the thermistor 111.

The leads 109 of the tilt sensor tube 108 are connected between the 115 discharge and threshold 116 pins of one half of the LM556 dual timer output 117 circuit 103, which adjusts the duty cycle of the timer, set to run in an astable configuration. The tilt sensor tube 108 is a hermetically sealed glass tube as described in Example 7. The microcontroller 104 detects the duty cycle of the timer circuit 103 output 117, and determines the inclination or acceleration forces of the tilt sensor tube 108. The tilt sensor tube 108 is mounted in the iron 156 handle (not shown in the Figures), in close proximity to the electronic circuitry, aligned with the axis 113 of the iron 156, so that the tilt sensor tube 108 conducts between the electrodes 109 when upright and does not conduct, except for sloshing of the fluid 110 in the tilt sensor tube 108 due to acceleration and deceleration, generally along the axis 113 of the iron 156, when in the horizontal use position.

The LM556 timer circuit 103 output 117 from the tilt sensor tube 108 is connected to a digital I/O port 118 of the PIC 16C54 microcontroller 104, where the signal is processed to determine the inclination of the iron 156, as well as acceleration along the axis 113 of the iron. When the iron is horizontal and heated to temperature, and not subject to movements which cause intermittent bridging of the conductive fluid between the electrodes for a period of approximately 45 seconds, the heat is turned off, and must be reset to again operate. When the iron is vertical for a period of more than 5 minutes, the iron is turned off, and must be reset again to operate.

The microcontroller 104 may also receive a water exhaustion indicator, alerting the user when a steam mode is selected and no water remains. The microcontroller 104 may also detect water quality, as by conductivity, ion detection or opacity, providing the user an indication that impure water is in the iron 156, which may damage clothes.

The microcontroller 104 controls heating of the iron 156 with a feedback temperature sensor, i.e., a thermistor 111, employed in a variable output oscillator circuit formed with a half of the LM556 dual timer circuit 105, whose output 119 is received by the microcontroller 104 through a digital I/O port 120.

It is noted that, where sophisticated water quality detection is desired, it may be preferable to employ an analog to digital converter, which is preferably part of the microcontroller 104 device, to input the sensor information. In this case, the LM556 dual timer circuit 103, 105 may be eliminated, and the input from the iron 156 temperature sensor (thermister 111) and tilt sensor tube 108 detected directly by the microcontroller 104, through the analog interface port(s). Suitable microcontrollers in this case include the Philips 87C552, and Microchip 16C71.

The microcontroller 104 controls the temperature of the iron using a pulse modulation scheme through the input of an MOC 3031 optically isolated triac driver 106, which in turn drives an MAC 3030-8 triac 107, which allows current to pass through the two terminals 121, 122 powering the resistive heating load 112. The triac 107 is turned off every zero crossing, e.g., 1/120 of a second for 60 Hertz line frequency, and is turned on intermittently based on the desired temperature and the timing logic.

Figure 14A:
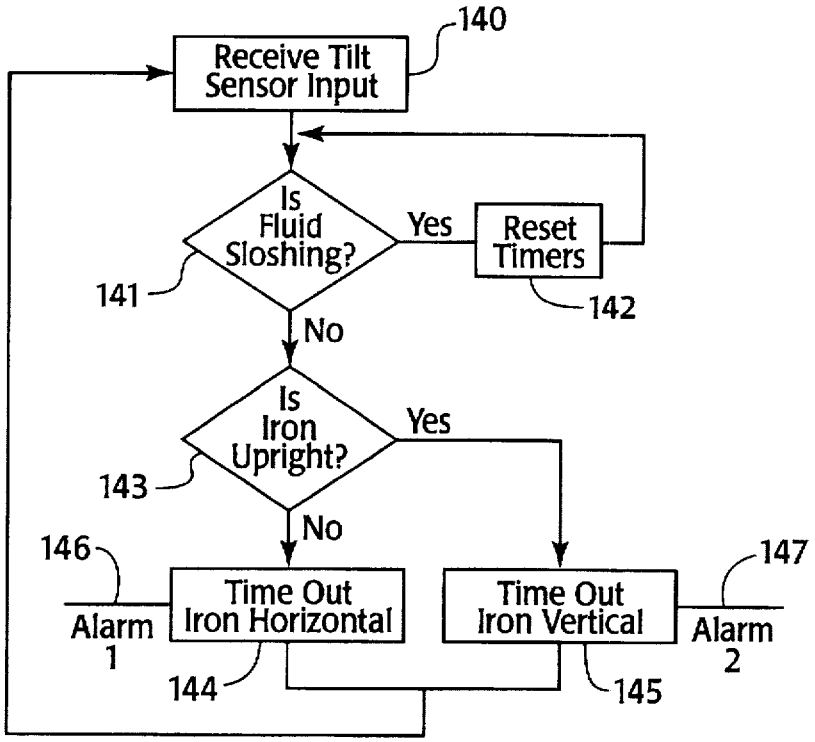
FIGS. 14A and 14B show a flow diagram of a method of controlling an iron according to the present invention.
Figure 14B:
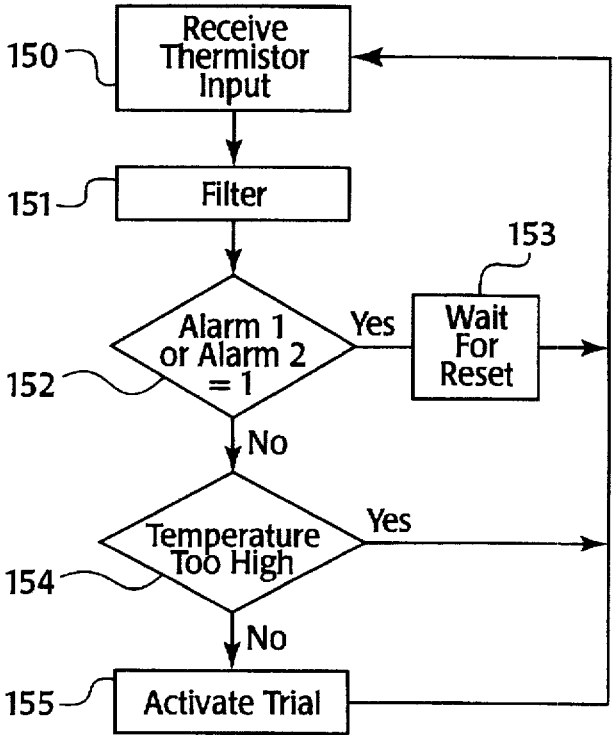

FIG. 14 shows a simplified logical flow diagram of an iron control according to the present invention. The Iron control executes a temperature control algorithm as shown in FIG. 14B, which may include simple thermostatic logic or more complex fuzzy logic, PID model, or other control algorithm for controlling the heating element of the heater. The thermistor input is received is 150 and is filtered 151. The heating algorithm 154 may be adaptive, in order to activate the triac 155 with a regular waveform at the triac input during static conditions and to predictively reduce temperature fluctuations in spite of dynamic conditions. This control algorithm may also take into consideration the inclination of the iron 156 and accelerations of the iron. The heating of the iron is halted if a time out alarm condition 152 exists, and the system awaits reset 153 in order to begin heating the iron 156 plate again.

As shown in FIG. 14A, the microcontroller 104 receives tilt sensor input 140 to determine whether the fluid in the tilt sensor tube is sloshing 141, as would occur during acceleration or deceleration. This is detected by frequent variations in the impedance of the tilt sensor tube, or more particularly, by an impedance variation within a timeperiod 142. The input from the tilt sensor tube may be prefiltered to improve acceleration sensing. In this event, the iron 156 is presumed to be in use, and the heating of the iron 156 plate will continue as developed further according to the method shown in FIG. 14B. When the sloshing stops, the orientation of the iron 156 is detected 143. If it is in the upright position, a first timeout timer is incremented 144. If it is not in the upright position, a second timeout timer is incremented 145. Any sloshing in the tilt sensor tube will reset the timers. When either of the timeout timers exceeds a predetermined threshold, an alarm condition 146, 147 is created which will stop heating of the iron 156 in step 152 of FIG. 14B.

To those skilled in the art to which this invention relates, many changes in construction and widely differing embodiments and applications of the present invention will suggest themselves without departing from its spirit and scope. Thus, the disclosure herein is purely illustrative and is not intended to be in any sense limiting.

What is claimed is:

1. An electrical switching circuit, sensitive to an externally applied inertial and gravitational force, comprising:

a liquid switch having an enclosed space, a non-metallic conductive fluid filling a first portion of said space and anon-conductive medium filing a second portion of said space, said conductive fluid and said non-conductive medium having differing densities; and at least two electrical contacts in communication with said space;

an electrical circuit coupled to at least one of said contacts and having a pair of electrical connections for connection with a power source and a load in series, having a semiconductor switching device, said semiconductor switching device being responsive to a current through said at least one contact, a current through said contacts causing said semiconductor switching device to change conductivity, wherein an externally applied force causes said conductive fluid to move within said liquid switch with respect to said at least one contact, altering a current through said contact, thereby changing a conducting state of said semiconductor switching device to selectively control a current flowing through said load, said current flowing through said load being substantially greater than a current through said electrical contacts, said current flowing through said electrical contacts being derived from said current flowing through said load; and a common housing, containing said liquid switch and said electrical circuit.

2. The electrical switch according to claim 1, wherein said conductive fluid comprises water.

3. The electrical switch according to claim 1, wherein said conductive fluid comprises an aqueous electrolyte solution.

4. The electrical switch according to claim 3, wherein said conductive fluid further comprises polyethylene glycol.

5. The electrical switch according to claim 2, further comprising a $C_1$ to $C_7$ alcohol in an amount sufficient to lower a freezing point of said conductive fluid to below about −10 C.

6. The electrical switch according to claim 1, wherein the externally applied inertial force is a tilting with respect to gravity.

7. The electrical switch according to claim 1, wherein the externally applied inertial force is an acceleration force.

8. The electrical switch according to claim 1, further comprising a pivoted mounting linked to said liquid switch.

9. The electrical switch according to claim 1, further comprising an elongated bimetallic temperature sensitive member linked to said liquid switch, varying an orientation of said liquid switch with temperature.

10. The electrical switch according to claim 1 wherein said semiconductor switching device comprises a silicon controlled rectifier.

11. The electrical switch according to claim 1 wherein said semiconductor switching device comprises a triac.

12. The electrical switch according to claim 1 wherein said semiconducting switching device comprises a MOS device.

13. The electrical switch according to claim 1, wherein said liquid switch comprises a hollow elongated member, said electrodes being proximate to one end of said member, said conductive fluid filling less than about half of said member.

14. The electrical switch according to claim 1, wherein said electrical contacts are formed of a material selected from the group consisting of stainless steel and nickel.

15. The electrical switch according to claim 1, wherein said electrodes each have a conductive surface area greater than about $\pi dh$, wherein d is a minimum cross section distance and h is a length of said electrode.

16. The electrical switch according to claim 1, wherein said electrical circuit further comprises a timing circuit, said timing circuit controlling a temporal relationship between said external force and said change in conductivity.

17. An electrical switch circuit sensitive to an externally applied inertial and gravitational force, comprising:

a liquid switch having an enclosed space, a dielectric fluid having a first dielectric property filling a first portion of said space and a medium having a dielectric property different from said dielectric fluid filling a second portion of said space, said dielectric fluid and said medium having differing densities, and at least two probes in communication with said space;

an solid state electrical circuit coupled to at least two of said probes, said electrical circuit having an electrical connection for connection with a power source and a load in series, and being responsive to a change in capacitance between said probes due to a change in position of said dielectric fluid with respect to said medium to selectively control a current flowing at an output of said electrical circuit, said current flowing at said output being substantially greater than a current through said probes, said current flowing through said probes being derived from said current flowing through said output.

18. A control system for an electrical system, comprising:

a liquid switch having an enclosed space, a conductive fluid filling a first portion of said space and a non-conductive medium filing a second portion of said space, said conductive fluid and said non-conductive medium having differing densities, said conductive fluid consisting essentially of an ionically conductive non-zero-valent metal composition, and at least two electrical contacts in communication with said space;

an electrical circuit coupled to at least one of said contacts for detecting a state of conduction between said contacts, said electrical circuit having an output, wherein an externally applied force causes said conductive fluid to move within said liquid switch with respect to said at least one contact, altering a conduction between said at least two contacts, to selectively control a current flowing at said output of said electrical circuit;

a housing, containing said enclosure and said electrical circuit; and a control circuit receiving said output from said electrical circuit and controlling the electrical system based on a said output, a current flowing through said electrical system being substantially greater than a current flowing through said contacts.

19. The control system according to claim 18, wherein said electrical system comprises an iron and said conductive fluid comprises an aqueous solution.

20. The control system according to claim 19, wherein said control circuit determines an inclination state of said iron and controls a heating of said iron based on said inclination state.

21. The control system according to claim 19, wherein said control circuit determines an time-varying acceleration state of said iron and controls a heating of said iron based on said time-varying acceleration state.

22. The control system according to claim 19, wherein said control circuit comprises a timer having an output, and a heating of said iron being controlled based on said output of said timer.

* * * * *